United States Patent [19]
Green
[11] 4,290,329
[45] Sep. 22, 1981

[54] TORQUE RELEASE WRENCH OF THE PRESET TYPE

[75] Inventor: Talmage O. Green, Schaumburg, Ill.
[73] Assignee: Snap-on Tools Corporation, Kenosha, Wis.

[21] Appl. No.: 82,854
[22] Filed: Oct. 9, 1979
[51] Int. Cl.[3] ..... B25B 23/142
[52] U.S. Cl. ..... 81/477
[58] Field of Search ..... 81/52.5, 52.4 R, 52.4 A, 81/483, 478, 477; 116/284, 309; 33/172 B

[56] References Cited

U.S. PATENT DOCUMENTS

| | | | |
|---|---|---|---|
| 2,312,104 | 2/1943 | Larson | 73/139 |
| 2,367,224 | 1/1945 | Larson et al. | 81/52.5 |
| 2,682,796 | 7/1954 | Larson | 81/52.5 |
| 3,535,958 | 10/1970 | Larson | 81/52.4 R |
| 3,608,403 | 9/1971 | Green | 81/52.5 |
| 3,763,724 | 10/1973 | Green | 81/52.4 R |
| 3,847,038 | 11/1974 | Green | 81/52.4 R |

*Primary Examiner*—James L. Jones, Jr.
*Attorney, Agent, or Firm*—Harry C. Alberts

[57] ABSTRACT

The structure in its preferred embodiment involves a preset control device for measuring instruments such as but not limited to torque release wrenches of the preset type wherein an elongated casing and handle confines a work engaging member, an elongated load translating member extends therefrom, and adjustible measuring instrumentalities are intergeared therewith to preset the turning load of release. The measuring instrumentalities are dominated by a simple and compact control unit disposed transversely of the elongated casing and handle member to provide a calibrated dial positoned to rotate in the path of a viewing opening in the casing for manual presetting to a selected load. More specifically, this calibrated dial is peripherally geared to mesh with a pinion fixed to a micrometer-like elongated screw which threadedly engages the work engaging translating member to synchronously set its position simultaneously with the rotary setting of the calibrated dial responsive to manually turning a knob fixed to an accessible end of the micrometer-like screw member. This provides a fully geared control unit to release the work engaging load translating member in relation to a trip element adjustably fixed to the interior of the elongated housing in the path of the translating member.

10 Claims, 7 Drawing Figures

TORQUE RELEASE WRENCH OF THE PRESET TYPE

This invention relates to turning devices and more particularly to preset torque measuring wrenches of the type illustrated in U.S. Pat. No. 2,682,796 issued July 6, 1954, No. 3,535,958 issued Oct. 27, 1970, No. 3,608,403 issued Sept. 28, 1971, and No. 3,763,724 issued Oct. 9, 1973, and No. 3,847,038 dated Nov. 12, 1974, although certain features thereof may be employed with equal advantage for other purposes.

It contemplates more especially the provision of a simple, dependable, accurate and compact preset control unit for torque measuring wrench that accurately designates the preset force to be applied and upon reaching this torque load will release and preclude any further nut turning and similar turning movements under all conditions. More particularly in its preferred embodiment, this invention is an improvement upon the preset control unit illustrated and claimed in U.S. Pat. No. 3,847,038, dated Nov. 12, 1974.

Most torque wrenches measure the flex in a beam or the torsional twist in a shank which resists the turning force of a wrench in order to measure the amount of torque or force applied in nut turning and similar operations. Both types of torque wrenches have been adapted to the conventional handle or lever arm type for manual turning load application in fastener tightening operations as evidenced by U.S. Pat. Nos. 2,312,104 and 2,367,224; however it is now deemed more productive and effective to preset a wrench of the measuring type so that the desired nut or other fastener tightening load will be indicated and mechanically released during use to preclude further tightening thereof and accomplish this with substantially immediate presetting and automatic resetting.

The present invention overcomes the requirement of relying upon a calibrated visual turning load reading dial or other measuring indicator for turning or other load determining instrumentalities that required attentive responsive interpretations that are time consuming, become tedious operations in a production line facility where repetition is a factor of split-second readings that vary depending upon the alertness of the attendant and the fatigue induced by such operations and requirements.

The desirability of utilizing the degree of twist in the shank or shaft or the flex beam principle as the measuring expedient in nut turning and similar operations, has been resorted to with success from the standpoint of measuring the applied turning load in relation to a calibrated meter that requires constant observations to reduce the error factor to a minimum as illustrated in the above referred to Letters Patents; however, it is now known that predetermined tightening loads can be imparted to fasteners by incorporating directly geared and calibrated improved presetting control or indicating instrumentalities to preclude variations in fastener tightening application without jarring the sensitive measuring elements thereof and, further, without relying upon the over-reaction or under-reaction of the user whose responses are not always uniform.

The importance of accuracy in torque wrenches cannot be over-emphasized, and the degree of accuracy depending largely upon the elimination of or substantial reduction in friction, lag and free-play between relatively moving parts. This is also important in torque wrenches that embody the principle of flexing a torque resisting beam to provide the desired reading; however, better results have been found possible in torsion type wrenches embodying teachings of the present invention.

In accordance with the teachings of the present invention, the torsion measuring principle has been embodied in the conventional type lever arm wrench with minimum friction, lag, free play, and maximum translation of the relative twist of the load carrying member. This has also been accomplished in conjunction with presetting torque load indicator instrumentalities which preclude errors and variations in reading and interpreting the usual indicators in all conditions of use. Torque measurements are possible, therefore, with a negligible error factor and nut turning operations are accurately measured under all conditions and capacities irrespective of human error and the position of applied force along the lever arm for effecting the turning operation.

It has been found in the acutal use of torque wrenches, especially in repetitive production line operations, that the attendant may become weary and not too observant of the indicator dial or he may be working under tiring conditions to always be sufficiently observant or when using such a device in obscure or inconvenient positions, inaccurate readings result. Also, there is little opportunity to read the dial in normally inaccessible places and, therefore, the user of a torque wrench may not be in the position to determine with any great deal of accuracy the torque load that is being applied. Furthermore, human error may render otherwise accurate torque measuring instrumentalities so ineffectual so that the present invention contemplates the elimination of human error and the other noted difficulties by providing simple automatic mechanical disconnect and connect control features that will convey to the user the knowledge that the applied torque has reached the predetermined value at which the measuring instrumentalities have been preset prior to the application of the device. To this end, it has been found desirable to provide simple disconnect and connect instrumentalities that render it mechanically impossible for the user to apply more torque load to a fastener than is initially intended without any overt act, and with the teachings of the present invention the presetting control or set means have been made more effective, direct and maintained against shifting or change while in use.

The mechanical indicator preferably takes the form of a trigger release mechanism operating responsive to a flex beam which will provide an automatic disconnect at the preset load so that the handle 10 will be momentarily ineffectual to apply more force for the further application thereof in nut turning operations. This construction provides partial releasing, since two beams 20–21 bend together after initial fractional loading of the primary beam 20 to share the torque load. Thus, the wrench handle 10 travels a certain arc (degrees) to sustain the preset load when the secondary beam 21 releases by reason of the trigger 24 being displaced therewith to engage the obstruction which, in this instance, is the calibrated wedge 31 that causes a trigger 24 disconnect. Then the primary beam 20 must take over the full load and these occurrences cumulatively create a momentary interruption, a mild vibratory shock and some audible click due to the trigger disconnect serving as a signal to the user who becomes conscious of the desirability not to over-pull by continuing the application of force.

The effect of this is to cause a sudden relaxation of part of the applied torque at the drive end 12 as the user kmows he must then stop as advised by the aforesaid cumulative release signals. Normal relation of all the instrumentalities then takes place due to the straight natural at reast attitude of the secondary beam 21 when the latter passes to its no stress point upon release of the trigger 24 which is then spring-urged to return to its initial position of engagement with the secondary beam 21. The free end 32 of the secondary beam 21 always maintains contact at some point with the unlatched trigger 24 even when the secondary beam 21 is released so that it assumes its straight attitude the re-latching of the spring urged trigger 24 is readily attained. This is aided by the fact that the primary beam 20 also assumes a straight attitude upon release and user relaxation to slightly displace the trigger 24 backwardly to assist in the re-latching trigger operation.

This would be true irrespective of the care exercised by the user or the position in which he was using the torque wrench or the inaccessibility of use which may preclude the direct vision to any calibrated indicator or measuring meter that has heretofore been used in devices of this character. These human failures have been entirely eliminated by utilizing mechanical disconnect instrumentalities that are responsive to the presetting instrumentalities when the torque load reaches the measurement for which the wrench is preset and the user receives the mechanical signal to relax his grip and stop applying further torque.

One object of the present invention is to simplify the construction and improve the operation of devices of the character mentioned.

Another object is to provide a simple and compact preset control unit for torque measuring devices that is accurate, dependable in operation, and embodies presetting measuring means inter-geared with the flex beams for accurately controlling the tightening load.

Still another object is to provide a torque measuring turning tool having improved inter-geared trigger and flex beam control disconnect means in the form of a simple, improved, and compact preset control unit associated therewith that is self-restoring upon manual release thereof after the disconnect occurs.

A further object is to provide a torque measuring turning tool with simple, effective and improved inter-geared micrometer screw and calibrated wheel turning instrumentalities for connecting and disconnecting the load turning elements at any predetermined torque load within the capacity range of the device.

A still further object is to provide a torque wrench with a turning shank having trigger release and restoring control serving as a mechanical inter-geared release with preset loading instrumentalities to insure accurate and rapid tightening of fasteners without human intervention except for applying the load until a disconnect occurs.

Still a further object is to provide an improved presetting and releasing torque wrench control unit to mechanically set and interrupt the applied torque load without the user's involvement therein during the tightening operation.

Other objects and advantages will appear from the following description of an illustrative embodiment of the present invention.

Figures 1, 2, 3, 4, 5, 6, 7:
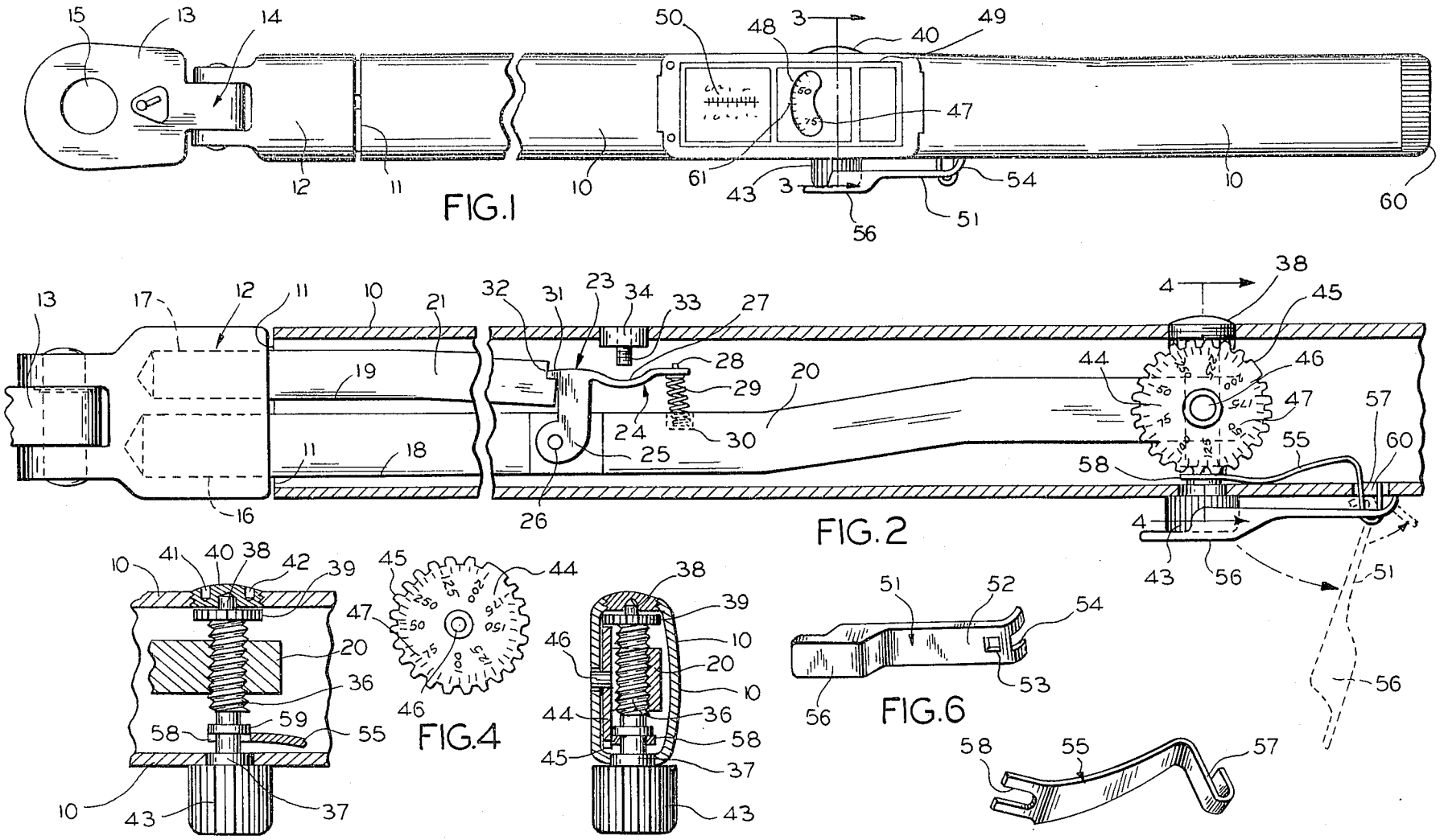
FIG. 1 is a top plan view of the device embodying features of the present invention.
FIG. 2 is an enlarged fragmentary view in elevation taken substantially along the mid-section line of FIG. 1 and cutting through the casing but showing all other internal working parts in plan to illustrate the compound primary and secondary flex beams with their preset release control elements.
FIG. 3 is an enlarged fragmentary sectional view of the preset control release screw connecting elements taken substantially along line III—III of FIG. 1.
FIG. 4 is a plan view of the calibrated gear comprising part of the preset control for mesh with the pinion attached to the preset load release adjusting screw.
FIG. 5 is a sectional view in elevation of the complete preset control release taken substatnailly along line V—V of FIG. 2, and illustrating the train of gears and a micrometer type of interconnecting screw accurately positioning the primary beam in its initial position for preset release of the applied torque load.
FIG. 6 is a perspective view of the lock lever for maintaining the preset control in its adjusted position without any possible accidental displacement thereof during the use of the torque wrench.
FIG. 7 is a perspective view of the flat spring articulated for application to the lock lever to maintain the latter in sprung position against the adjusting knob comprising part of the preset control release elements.

The structure selected for illustration is not intended to serve as a limitation upon the scope or teachings of the invention, but is merely illustrative thereof. There may be considerable variations and adaptations of all or part of the teachings depending upon the dictates of commercial practice. The present embodiment comprises an elongated tubular handle member 10, in this instance of rectangular cross-section, to also serve as a housing for instrumentalities to be hereinafter described. The forward end 11 has a projecting work engaging member 12 complementarily sized for closing the handle end 11 with minimum looseness to preclude interaction therebetween.

The projecting work engaging member 12 has, in this instance, a standard ratchet head 13 pivotally connected thereto as at 14 to provide a standard ratchet arbor 15. The projecting end of the arbor 15 has a correspondingly shaped square wrench socket receiving shank (not shown) of well known construction to detachably receive nut sockets of varying sizes. The shank is preferably though not essentially fitted with properly spaced standard spring impelled ball detents to frictionally retain the sockets thereon. The pivotal ratchet head 13 enables variation in the angle of applied torque loads with convenient ratcheting action in normally inaccessible places for tightening and loosening fasteners such as threaded nuts on mechanical assemblies of every kind and character.

The work engaging head 12 is retained in the elongated handle 10 by providing properly spaced bores 16–17 therein of slightly smaller diameter than the diagonal corners of squared ends 18–19 on the primary and secondary flex beams 20–21 (FIG. 2). The diagonal corners of the squared flex beams 20–21 are dimensioned somewhat greater than the diameters of their corresponding work engaging head bores 16–17 to require a machine impacted forced pressure fit therebetween to provide an integrated handle 10–12, flex beam 20–21 and work engaging head 12 connection therebetween to operate as a rigid integrated (one piece) structure to apply preset nut turning loads to threaded fasteners through interfitting wrench sockets frictionally attachable and detachable relative to the work engaging head shank (not shown) in registry with a nut or other standard fastener.

As previously stated, the longer primary flex beam 20 and the shorter secondary flex beam 21 are press-fitted into complementary recesses or bores 16–17 provided in the work engaging head 12 so that both beams 20–21 ultimately resist the turning movement applied through the handle member 10 as the preset load is approached and both beams 20–21 flex as will appear more fully hereinafter. The secondary beam 21 is approximately one-half the length of the primary beam 20 which flexes first to carry a trigger release mechanism 23 into connecting operative relation to the secondary beam 21. A coiled spring 29 is interposed between the underside of the nib 28 and a recess 30 in the primary beam 20 to normally urge the trigger 23 in a counter-clockwise direction so that its projecting ledge 31 will normally engage the stepped end 32 of the secondary beam 21.

The trigger connecting and releasing mechanism 23 involves a trigger 24 that has a depending boss 25 pivotally connected to the primary beam 20 proximate to its midpoint by a pin 26. The trigger 24 of the upstanding trigger release 23 has a horizontal portion 27 of the trigger 24 having an upwardly projecting nib 28 thereon to contact any suitable trip means such as an adjustable screw 33 threadedly engaging a casing reinforcing disc 34 welded or otherwise fixed into the wall of the elongated handle 10 in the arcuate horizontal region of the trigger body 24–27.

Now, then, the trigger connecting end of the secondary beam 21 is notched as at 32 to present a stepped shoulder complemental to the stepped edge 32 provided on the adjacent free end edge of the trigger 24 to connect therewith responsive to the clockwise urge imparted to the trigger 24 by a compression spring 29. The compression spring 29 is vertically disposed between a recess 30 and the underside the trigger nib 28 to urge the trigger in a counter-clockwise direction, the recess 30 being provided in the upper edge of the primary flex beam 20 to retain the spring 29 in operative position at all times independent of the positioning of the wrench handle 10 or its movement in applying the torque load to a fastener.

This tends to latch the trigger's projecting end 31 against and onto the completely stepped edge 32 of the secondary beam 21 whenever the latter is proximate thereto. This occurs during the initial flexing of the primary beam 20 say to one-half of the predetermined and preset load, and coincident thereto the secondary beam 21 will present its stepped edge 32 for registry with the trigger's complemental projecting end 39 to establish their connection. Therefore, further increasing the turning load will cause bending or flexing of both beams 20–21 and elevate the trigger 24 with its arcuate portion 27 until the latter is obstructed by the trip screw 33. When this occurs, the latched stepped connection 31–32 becomes disconnected because the trigger 24 is pivoted in a clockwise direction (viewed from FIG. 2), and a partial interruption to further turning the fastener takes place. This momentary interruption brings about a metal-to-metal contact between the secondary beam 21 and the upper inside wall of the tubular handle member 10 as the secondary beam 21 springs back from its curved loaded attitude to an unloaded straight attitude and the trigger 24 becomes unlatched by its contact with an obstructing trip element such as the adjustably mounted screw 33 depending from the wall of the elongated casing 10.

The user immediately is alerted by the mechanical disconnect constituting a definite audible metal-to-metal impingement signal that the preset load has been reached and the user must then release his applied force in order to allow the primary beam 20 to also return to its initial straight shape or attitude so that the trigger 24 may again latch itself to the stepped end 31–32 of the secondary beam 21 responsive to the urge of the trigger spring 29. The instrumentalities are restored to their initial position for repeating the torque load applying cycle merely by the user's momentary release of the applied force when the audible and physical signals evidence that the preset turning load has been reached.

When this occurs, the handle 10 is momentarily released to allow the secondary beam 21 to be re-latched to the trigger 24 by allowing its projecting latching end 31 to ride over and again engage the approaching stepped end 32 of the secondary beam 21. This returns all the working parts to their initial position so that the next turning load may be applied for repetitive use of the wrench to other fasteners. This is rendered possible with new and improved preset control release instrumentalities provided, in this instance, at the free end of the primary beam 20 that preferably has a micrometer like threaded screw 36 (FIGS. 3 and 5) which is transversely journalled in the elongated casing 10 in one edge region as at 37 and also in its other opposite edge region as at 38 that carries a pinion 39 to turn therewith. A micrometer-like threaded member is sufficiently precise in its uniform threaded lenght to move the elements geared thereto back and forth to the same position or the preset positions of the calibrated dial without any significant variation to insure accurate control in presetting the release thereof. The upper screw end 38 is rotatively supported in a bearing cap 40 that is in threaded connection with the handle 10 in the edge thereof at a position substantially in line with the otherwise free end of the primary flex beam 20 (FIG. 3). Special wrenching recesses 41–42 are provided in the bearing cap 40 to insure a tight threaded fit with the threaded mounting edge of the handle 10.

The other screw end 37 has a knurled finger knob 43 attached to an externally projcting portion of the screw stud 36 to enable manual turning thereof to adjust the preset control release instrumentalities as will presently be described in connection with the screw 36 which is threadedly connected with the end region of the primary flex beam 20 (FIG. 3). A circular flat turning torque load calibrated gear plate 44 having peripheral gear teeth 45, meshes with the pinion 39 attached to the upper screw end 38 (FIG. 5). To this end, the circular torque load calibrated gear plate 44 has an axial mounting stud 46 which is journalled in the bottom wall of the handle 10 to insure the free rotation thereof with the pinion 39 that is driven by the micrometer-type screw 36.

To this end, the circular substantially flat gear plate 44 is calibrated in this instance in foot pounds, and the calibrations 47 are impressed on the face thereof to render them visible through an arcuate opening 48 provided in a readout rectangular plate 49 attached to the top wall of the handle 10. This plate 49 is provided with instruction data 50 and range limits so that the user may know the limits of use for any particular wrench which will vary depending upon the size and capacity thereof. These preset wrenches may also be calibrated in scales other than foot pounds such as Newtons, inch pounds, and in metric scales for that matter. In that event, the calibrated gear plate 44 would be correspondingly calibrated and the instructions 50 on the reading plate 49 would indicate the particular scale for which any particular wrench is calibrated. With this direct preset control, no conversions or calculations need be required at the instance of the user, it is quick-setting, and accurate without any variables.

In order to maintain any selected setting of the preset control release against accidental displacement during the use of the device or while not in use, a locking lever 51 is provided with a flat shank 52 having its end region perforated as at 53 with its extreme edge notched as at 54 to cooperate with a flat spring 55 (FIGS. 6 and 7) so that the locking lever 51 with its dished free-end cap 56 will be shiftable against the complemental adjusting knob 43 to frictionally hold the latter tight against any possible rotation with the aid of the articulated flat spring 55. The flat spring 55 is articulated with a curved end 56 to interfit with the perforation 53 in the locking lever 51 so that the former's curved end 57 will cooperate with the notched end 54 of the locking lever 51 to afford the sprung association therebetween.

The other end of the spring 55 is bifurcated as at 58 to receive the lower end of the screw 36 below a peripheral flange 59 constituting an integral part of the screw stud 36 (FIG. 3). Thus, the articulated spring 55 is sprung between the screw stud 36 and the locking lever 51 after the former projects through an opening 60 (FIG. 2) in the elongated handle 10. With this arrangement, the frictional locking cap 56 may be displaced over the adjusting hub 43 as illustrated in solid outline in FIG. 2 to tightly grasp it against movement or it can be flipped therefrom against the urge of the spring as shown in dotted outline in the same illustration (FIG. 2) to allow the calibrated gear plate 44 to be manually reset. The end cap 60 on the free end of the handle 10 merely is ornamental and serves as a closure for the elongated tubular handle 10.

The trigger 24 tends to latch its projecting ledge 31 upon the stepped shoulder 32 of the secondary beam 21 owing to the urge of the compression spring 29 so that both beams 20–21 resist the flex therein occasioned by the applied load as it increases to its preset limit. At this point, the arcuate region 27 of the trigger 24 will be obstructed by the adjustable stud 33 disposed in its path. When this occurs, the latched connection 31–32 becomes disconnected because the trigger 24 is pivoted in a clockwise direction (viewed from FIG. 2), and a partial interruption to further turning the fastener takes place. This momentary interruption brings about a metal-to-metal contact between the secondary beam 21 and the upper inside wall of the tubular handle member 10 as the secondary beam 21 springs back from its curved loaded attitude to an unloaded straight attitude and the trigger 24 becomes unlatched by its contact with the obstructing screw 33 in the handle 10.

The user immediately is alerted by the mechaical disconnect constituting a definite audible metal-to-metal impingement signal that the preset load has been reached and the user must then release his applied force in order to allow the primary beam 20 to also return to its original shape or attitude so that the trigger 24 may again latch itself to the stepped end 31–32 of the secondary beam 21 responsive to the urge of the trigger spring 29. The instrumentalities are restored to their initial position for repeating the torque load applying cycle merely by the user's momentary release of the applied force when the audible and physical signals evidence that the preset turning load has been reached. When this interruption occurs at the time that the preset load has been reached and the release of the trigger 24 has been negotiated, the beam 20 does not remain rigid but it retains a marked reserve of elasticity. This reduces the amount of over-torque to fasteners even though the user inadvertently pulls through a greater arc than the preset load calls for upon release.

The preset load can easily be varied by turning the calibrated gear plate 44 to any other preset release load within the range of the wrench. The calibrated gear plate 44 is set by turning the finger operated knob 43 with reference to a marker 61 impressed on the arcuate sight opening 48 in the viewing plate 49 attached to the elongated handle 10 in the vicinity of the preset control release instrumentalities of which the calibrated gear plate is the confronting element to be viewed.

Various changes may be made in the embodiment of the invention herein specifically described without departing from or sacrificing any of the advantages of the invention or any features thereof, and nothing herein shall be construed as limitations upon the invention, its concept or structural embodiment as to the whole or any part thereof except as defined in the appended claims.

We claim:

1. A preset torque wrench or the like comprising a tubular elongated handle member, a pair of superposed flex beams disposed along and within said elongated handle member, a work engaging head member anchored to the ends of said flex beams to serve as a closure for said elongated tubular handle member, means for detachably connecting said flex beams together to share the torque load and to displace said work engaging member commensurate with the flex of said beams, said detachable means being displaced a fixed distance with said flex beams until actuated by engagement with said tubular handle member to limit any further displacement thereof to effect the release of said flex beams from each other, calibrated rotary scale means journalled in said elongated tubular handle member, and a micrometer-like threaded spindle journalled in said handle member proximate to said calibrated rotary scale means, said calibrated rotary scale means being geared to said micrometer-like threaded spindle that is operatively connected to one of said flex beams to control the flexing moment arm thereof, thereby presetting the load at which said detachable beam connecting means is actuated to release said beams from connected engagement to signal and momentarily arrest any further torque load turning of said work engaging member.

2. A preset torque load wrench defined in claim 1 wherein said calibrated scale means includes a flat surface gear and a pinion operatively connected thereto and to rotary turning means including an end knob to set said calibrated rotary scale means and connected flex beam.

3. A preset torque load wrench defined in claim 2 wherein said tubular elongated tubular handle member is provided with a viewing opening in the path of said calibrated flat surface gear to enable the presetting of said flex beams to operate said detachable means commensurate with the presetting of said calibrated surface gear.

4. A preset torque load wrench defined in claim 3 wherein said flex beams, calibrated surface gear and meshing pinion are in operative engagement with a threaded spindle journalled in said elongated tubular handle member to render such responsive to the turning of said spindle for presetting said instrumentalities.

5. A preset torque load wrench defined in claim 4 wherein said threaded spindle has manually accessible means which includes a knob and a cap screw bushing to maintain said threaded spindle in operative smooth turning relation to said flex beam, pinion and calibrated surface gear.

6. A preset torque load wrench defined in claim 5 wherein said threaded spindle knob cooperates with a complementally shaped lever cap spring mounted in confrontable relation to said knob to frictionally maintain the latter in adjusted preset position.

7. A preset torque load wrench defined in claim 6 wherein said confrontable lever cap is movably connected to a flat spring to resiliently urge said cap against said knob for frictionally holding the position of the latter against movement.

8. A preset torque load wrench defined in claim 7 wherein the operative and inoperative position of said lever cap relative to said knob is controlled by movably positioning said lever cap relative to said flat spring in relation to said knob.

9. In a preset torque wrench or the like, the combination with a work engaging member, of load turning resisting means operatively connected to said work engaging member, load releasing means in the path of said load resisting means when the latter reaches a preset load position, a calibrated rotating dial to preset the load release, means intergeared between said calibrated dial and said turning load resisting means to synchronously set the latter's position simultaneously with the rotary setting of said calibrated dial, and means to rotate said last named intergeared means in either direction of rotation setting of said calibrated dial to synchronously reset said calibrated dial and turning load resisting means to change the presetting release positions thereof.

10. A preset torque wrench or the like defined in claim 9 wherein said intergeared and rotating means include an elongated micrometer-like threaded member and a pinion fixed to said micrometer-like threaded member for effecting the rotation of said calibrated dial in either direction for presetting with said pinion meshing with said calibrated dial and said micrometer-like threaded member meshing with said turning load resisting member to synchronously control their release position indicated by said calibrated dial presetting.

* * * * *